US006146036A

United States Patent [19]

Kim

[11] Patent Number: 6,146,036

[45] Date of Patent: Nov. 14, 2000

[54] ROTATABLE CAM DEVICE FOR A PICKUP ROLLER OF A PRINTER

[75] Inventor: Dong-Hun Kim, Kyungki-do, Rep. of Korea

[73] Assignee: SamSung Electronics Co., Ltd., Suwon, Rep. of Korea

[21] Appl. No.: 09/181,807

[22] Filed: Oct. 29, 1998

[30] Foreign Application Priority Data

Oct. 29, 1997 [KR] Rep. of Korea ..... 97-55785

[51] Int. Cl.[7] ..... B41J 11/58; B65H 3/06

[52] U.S. Cl. ..... 400/629; 400/624; 400/625; 271/118

[58] Field of Search ..... 400/624, 625, 400/629; 347/104, 216; 271/118

[56] References Cited

U.S. PATENT DOCUMENTS 5,419,543 5/1995 Nakamura et al. ..... 271/9
5,515,094 5/1996 Tanaka et al. ..... 347/104
5,725,319 3/1998 Saito et al. ..... 400/629
5,867,196 2/1999 Kiyhara et al. ..... 347/104

*Primary Examiner*—Daniel J. Colilla
*Attorney, Agent, or Firm*—Robert E. Bushnell, Esq.

[57] ABSTRACT

The present invention relates to a device for switching a pickup roller of an inkjet printer to eliminate an unnecessary load due to maintenance of a contact state between the pickup roller and a knockup plate. The device maintains the contact state between the pickup roller and the knockup plate during a paper feed operation by mounting a rotatable cam device on the paper feeder part. The cam separates the pickup roller from the knockup plate according to the rotational direction of the line feed motor 24 as the driving system of the paper feeder part. After the feed operation has ended, the cam separates the pickup roller from the knockup plate and, as a result, an unnecessary load after the paper feed has ended is eliminated. A uniform quality for the line feed can be gained by feeding the paper without an excessive load at the beginning, and accordingly loss of printing quality (white line, etc.) is prevented.

19 Claims, 6 Drawing Sheets

ROTATABLE CAM DEVICE FOR A PICKUP ROLLER OF A PRINTER

CLAIM OF PRIORITY

This application makes reference to, incorporates the same herein, and claims all benefits accruing less, than 35 U.S.C. § 119 from my application entitled *Pickup Roller Switch Device of Inkjet Printer* filed with the Korean Industrial Property Office on Oct. 29, 1997 and their duly assigned Serial No. P97-55785 by that Office.

BACKGROUND OF THE INVENTION

1. Technical Field

The present invention relates to a device for simplifying the feeding motion of an inkjet printer and, more particularly, to a device for switching a pickup roller of an inkjet printer so as to eliminate an unnecessary load due to maintenance of a contact state between the pickup roller and a knockup plate.

2. Related Art

Generally, data or files composed by users with computers become documents by being printed with various kinds of printers. Whereas various types of printers are used, the present invention will be explained for the case of an inkjet printer. If ink stored in a cartridge head is heated, the pressure within the cartridge head rises, and bubbles (like soap bubbles) occur. The inkjet printer prints by forming letters and attaching them to the print paper by jetting bubbles occurring al that time through a nozzle.

The number of nozzles used in an inkjet printer generally amounts to about 64 pieces, and pictures usually have about 300~1200 DPI (Dot Per Inch) resolution. Also, color printing is possible with some sorts of installed cartridges.

Generally, an inkjet printer includes a paper feeder, a paper transporter, a printing part, a paper discharger, and a home position part. The operation of such an inkjet printer is described in detail below. As pointed out below, there are problems with such inkjet printers and their operation. Among such problems are: non-feeding of paper; jams during the paper feeding operation; unnecessary loads during transport of the paper; irregular carrying of the load causing unfixed line feed quantity (i.e., variation in line feed); and consequent printing problems (e.g., occurrence of white line(s) in printed graphics).

SUMMARY OF THE INVENTION

Accordingly, in order to overcome such drawbacks in prior arrangements, it is an object of the present invention to provide a device for obtaining an established quantity of line feed by eliminating an unnecessary load due to the maintenance of a contact state between a pickup roller and a knockup plate of a paper feeder part after the paper has been picked up from the paper feeder part.

To achieve these and other advantages and in accordance with the purpose of the present invention, as embodied and broadly described, there is provided a rotatable cam device part separating the knockup plate from the pickup roller according to the direction of rotation of a line feed motor as the driving part.

The rotatable cam device part comprises: a compression spring as an elastic member added to both sides left and right, and always pushing to the center of the left-right movable path; a guide rib separating a pickup roller and sheets on the upper edge of a knockup plate; and a rotatable cam located in the center of the arrangement and mounting or dismounting the guide rib by receiving power from a driving part.

BRIEF DESCRIPTION OF THE ATTACHED DRAWINGS

A more complete appreciation of the invention, and many of the attendant advantages thereof, will be readily apparent as the same becomes better understood by reference to the following detailed description when considered in conjunction with the accompanying drawings in which like reference symbols represent the same or similar components, wherein.

DETAILED DESCRIPTION OF PREFERRED EMBODIMENT

It will be apparent to those skilled in the art that various modifications can be made in the device for switching a pickup roller of an inkjet printer of the present invention without departing from the spirit of the invention. Thus, it is intended that the present invention cover such modifications as well as variations thereof within the scope of the appended claims and their equivalents.

The construction and operation of the present invention can be described in detail in conjunction with the accompanying drawings as follows.

Figure 1:
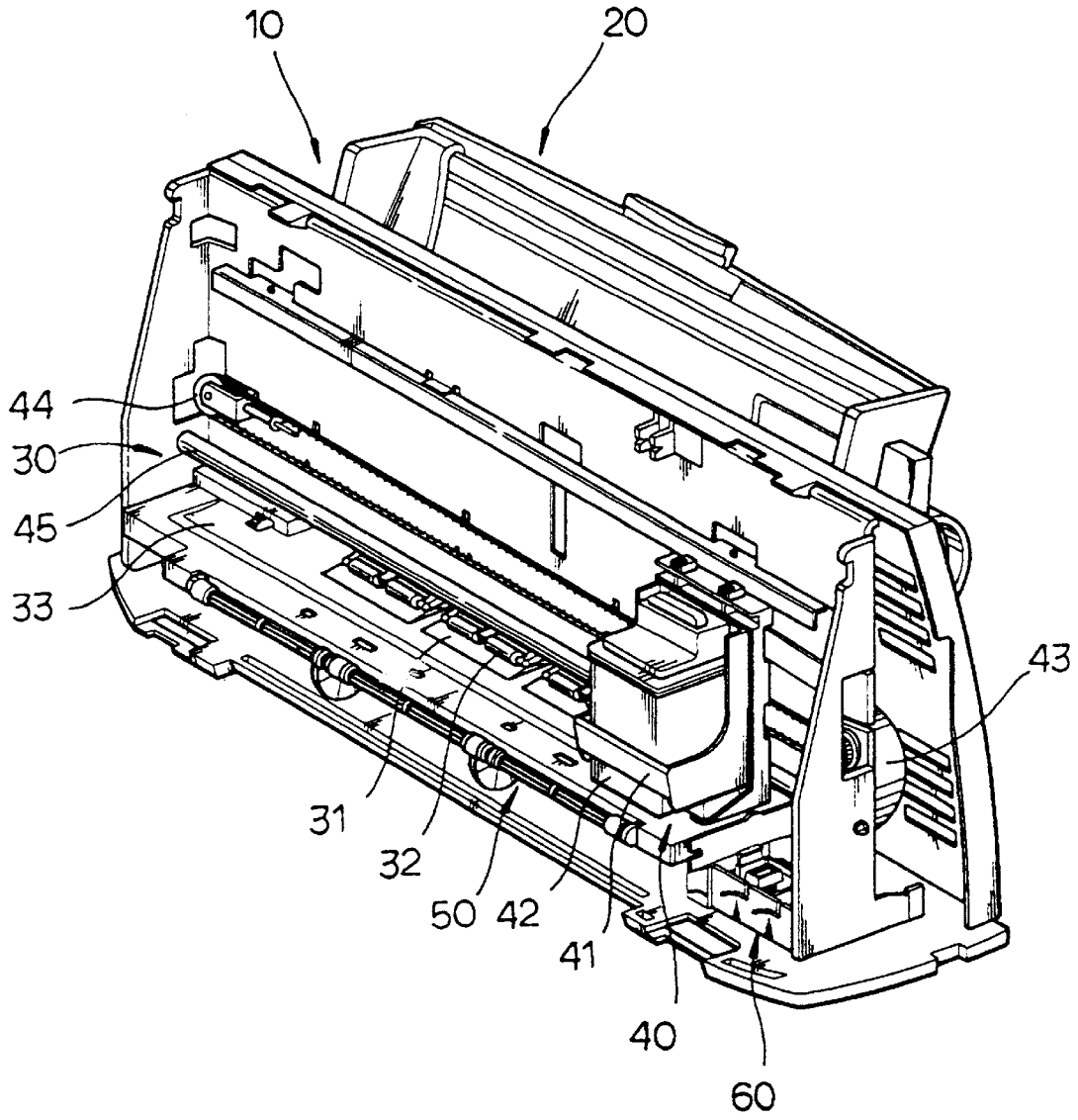
FIG. 1 is a perspective view illustrating the overall construction of an inkjet printer.
Figure 2:
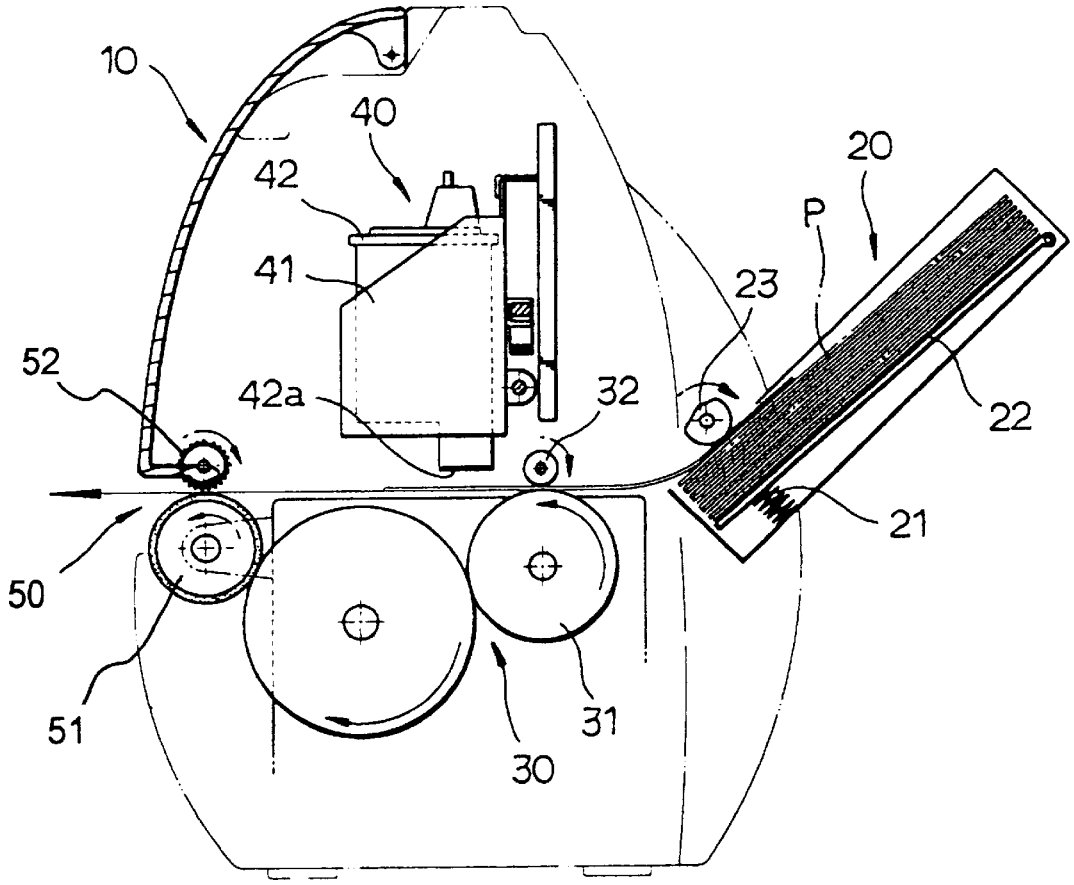
FIG. 2 is a right side view illustrating the operation of the arrangement of FIG. 1.

A general inkjet printer 10, as illustrated in FIG. 1 and FIG. 2, comprises a paper feeder part 20 which feeds paper for printing, a paper transporter part 30 which transports paper fed from the paper feeder part 20, a printing device part 40 for printing on the paper transported by the paper transporter part 30, a paper discharger part 50 for discharging the paper printed by the printing device part 40, and a home position device part 60 for capping or wiping after the printing device part 40 has printed.

The operation of the latter arrangement can be described in detail as follows. Paper is placed in the paper feeder part 20. When the paper is raised by the elastic force of a knockup spring 21, a pickup roller 23 picks up the paper stacked in a knockup plate 22 and transports the sheets of paper, one by one, to the paper transporter part 30.

The paper transported to the paper transporter part 30 is then transported to the printing device part 40 by the driving of a feed roller 31 and a friction roller 32.

Once the paper is fed from the paper transporter part 30, then a carriage driving motor 43 drives carriage 41. That is, belt 44 is driven by the carriage driving motor 43 so that cartridge 42 on carriage 41 moves to the left and right along a carriage shaft 45, and printing on the paper occurs through nozzles 42*a* mounted on cartridge 42.

The paper being printed through operation of the nozzles 42*a* mounted on cartridge head 42 moves gradually on a base frame 33, line by line. Once the printed paper reaches the paper discharger part 50, a discharge operation to discharge the paper with a discharge roller 51 and a star wheel 52 is performed.

Thus, the print process of the inkjet printer 10 can be described as follows: first, the paper is carried to the paper feeder part 20, and then transported to the paper transporter part 30 according to a print command; then, the printing device part 40 discharges the paper printed according to a controlled print command through the paper discharger part 40, and the process ends.

Figure 3:
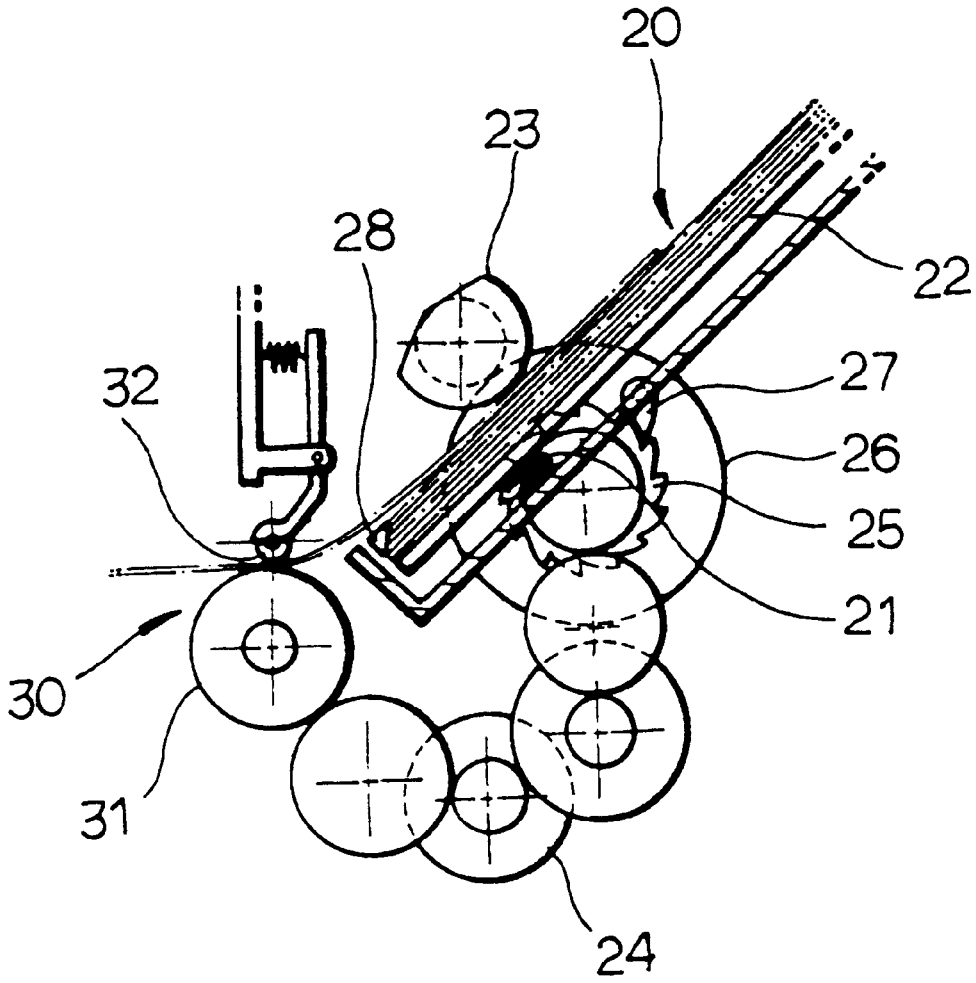
FIG. 3 is a perspective view illustrating a driving part of the paper feeder part according to FIG. 1.

The paper pickup process can be considered in detail with reference to FIG. 3. The process of feeding a paper to the feed roller 31 and the friction roller 32 by separating the paper sheets, one by one, with a finger 28 is necessary in order to transport the paper to the printing position after the pickup roller 23 has picked up paper from the automatic paper feeder part 20 which stores a great deal of paper.

That is, the arrangement has a non-driving state in which the pickup roller 23 driven by the line feed motor 24 is rotated counterclockwise in printing, while being rotated clockwise in picking up the paper.

The fed paper is pushed up to a rear edge part of paper feeder part 20 by rotation of pickup roller 23. The edge part of the paper is bent by finger 28, and the paper is fed via separation of each paper sheet by finger 28.

Thus, as the line feed motor 24 rotates clockwise, the pickup roller 23 rotates clockwise, and a pickup operation causing the paper to be geared between the feed roller 31 and the friction roller 32 is performed.

If the feed roller 31 also rotates clockwise, fed paper is unintentionally bent. If some bending occurs between the pickup roller 23 and the paper, the paper does not advance, and non-feeding of the paper and paper-jams occur due to the bending of the paper.

The line feed motor 24 allows the feed roller 31 to rotate in the counterclockwise direction and move to the printing position by rotating in a direction opposite to the direction of the initial pickup motion.

As the, pickup roller 23 does not rotate due to the direction of the power switching gear 26 as shown in FIG. 3, the pickup roller 23 does not work when the feed roller 31 feeds paper.

Subsequently, if the line feed motor 34 is again rotated in the counterclockwise direction, the feed roller 31 rotates counterclockwise and transports the paper to the initial printing position, and paper feeding motion ends at that point.

At this point, the pickup roller 23 assumes a non-driving or idle state in which it can be rotated only by the paper geared between the paper feeder part 20 and pickup roller 23 because power is switched off by the idle rotation of the power switch gear 26 with respect to the latch tool 25 and the stopper 27.

In this arrangement, the friction power between the pickup roller 23 and the paper (due to action of the knockup spring 21 attached to the lower edge of the knockup plate 22) works continuously after the paper has been transported to the feed roller 31 and the friction roller 32 from the paper feeder part 20. Consequently, a problem arises in that unnecessary loads are carried during transport of the paper.

In addition, a further problem occurs in that the line feed quantity is not fixed due to irregular carrying of the load.

That is, in this arrangement, the load disappears rapidly after a certain quantity of line feed, and thus the load balance between various parts changes rapidly. Therefore, the line feed quantity is changed abruptly, and as a result, a white line occurs in the graphics or a similar problem occurs.

Figure 4:
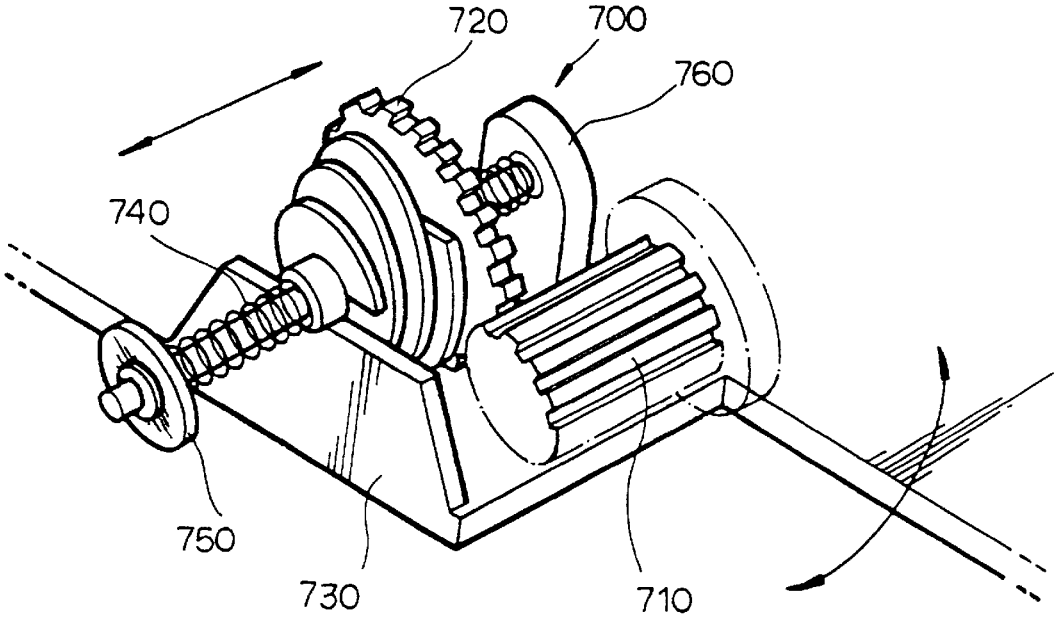
FIG. 4 is a perspective view illustrating the rotatable cam device part according to the present invention.
Figure 5:
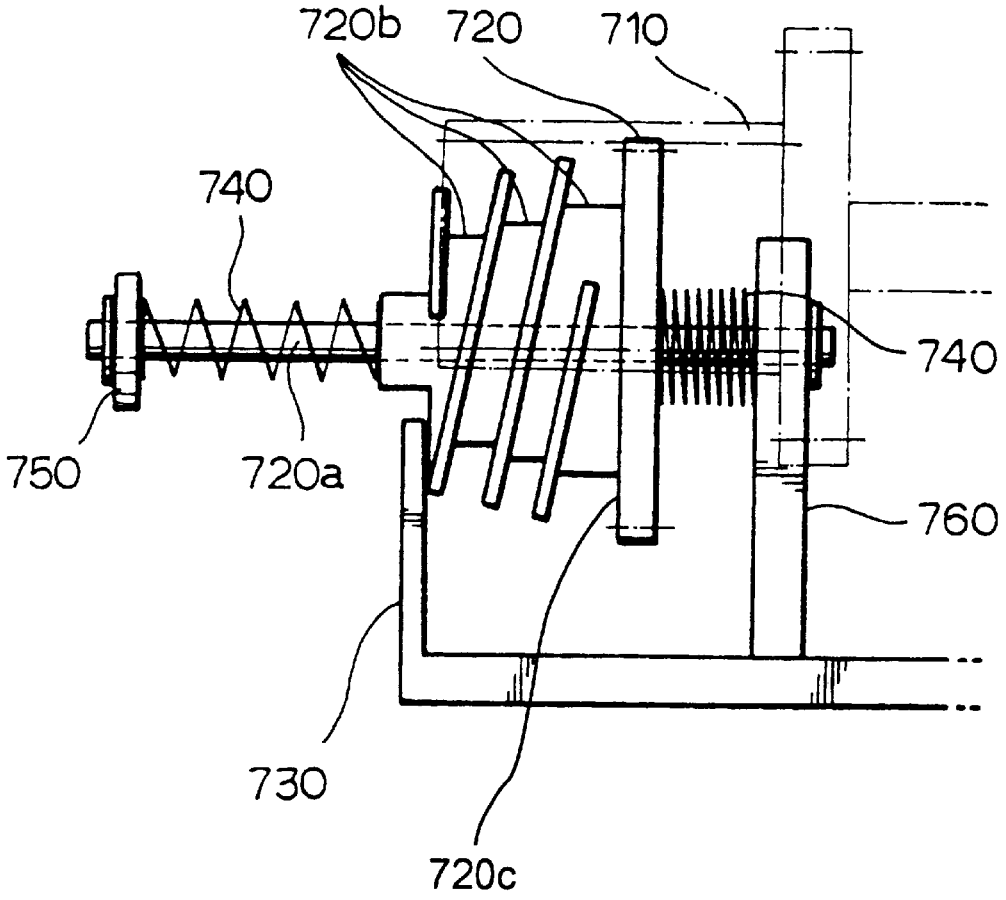
FIG. 5 is a front view of the rotatable cam of FIG. 4.
Figure 6:
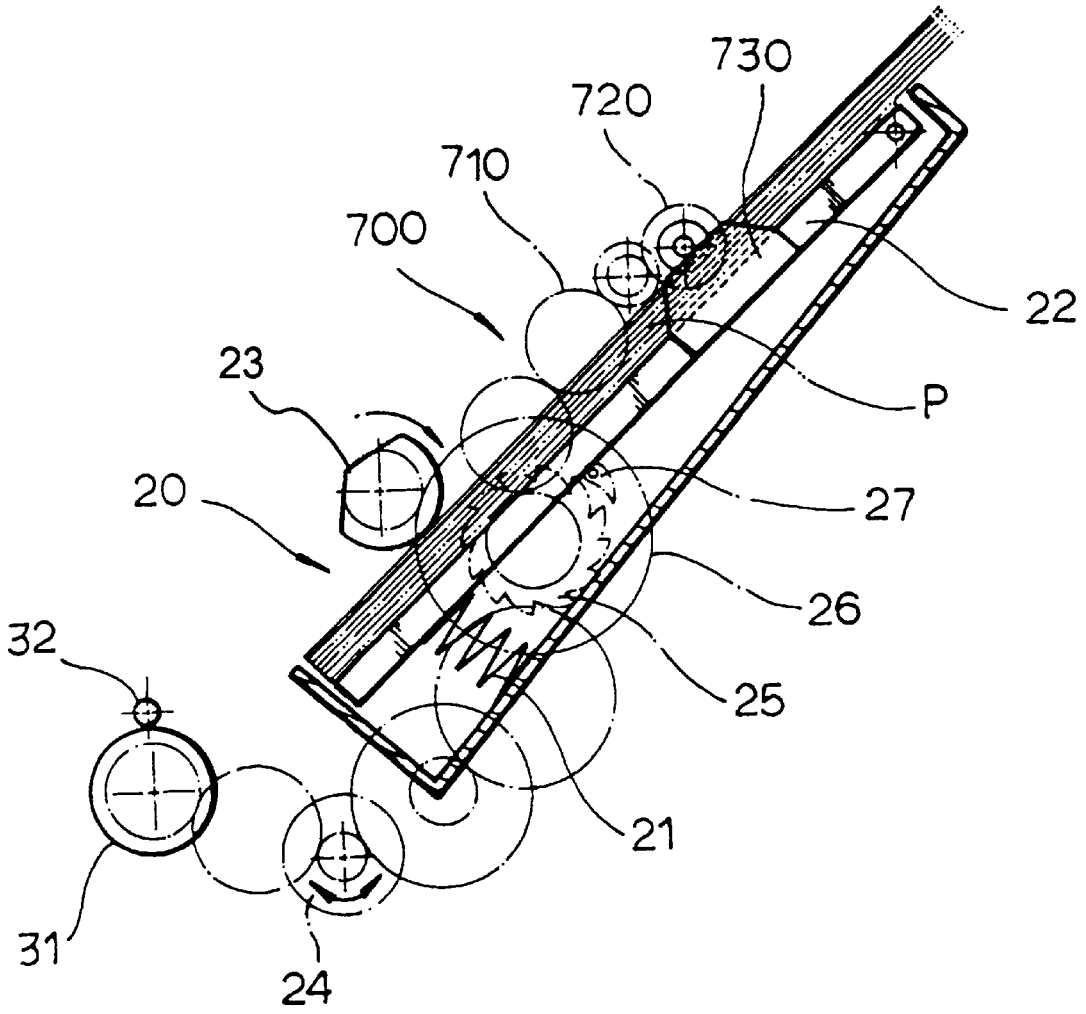
FIG. 6 is a right side view illustrating the operation.

FIGS. 4, 5 and 6 illustrate a device according to the present invention and its operation. In accordance with the invention, the device maintains a state of contact between pickup roller 23 and paper on knockup plate 22 during the paper feed operation. After the feed operation has ended, the cam device 700 separates the knockup plate 22 from the pickup roller 23 and, as a result, eliminates an unnecessary load on roller 23 after the paper feed has ended.

The rotatable cam device and its operation can be described as follows. As shown in FIG. 4, the rotatable cam device 700 comprises a compression spring 740 serving as an elastic member on the left and right sides of a spiral rotatable cam 720. The spring 740 pushes to the center of the left-right movable path of cam 720. A guide rib 730 separates pickup roller 23 (FIG. 3) and sheets along the cam surface by being mounted on the upper edge of the knockup plate 22 (FIG. 3). The spiral rotatable cam 720 is located in the center of the arrangement, mounting or dismounting the guide rib 730 by receiving power from a driving part and a slide gear 710 which drives the rotatable cam 720.

Moreover, the compression spring 740 and the rotatable cam 720 are formed on a rotatable shaft 720*a* (FIG. 5) fixed to the guide 750, 760 for preventing left-right secession.

The operation of this arrangement is as follows. When a printer gets a print command to print data from a computer (not illustrated) operated by a user, the line feed motor 24 (FIGS. 3 and 6) rotates clockwise in order to pick up paper P located in the knockup plate 22 of the automatic paper feeder part 20.

Accordingly, the pickup roller 23 rotates clockwise, and the paper P is picked up by the rotational forces of the pickup roller 23 and geared between the feed roller 31 and the friction roller 32. At this point, the spiral rotatable cam 720 and the guide rib 730 connected to the cam 720 are continuously rotated in a mutual state of separation. When the operating process of the rotatable cam 720 is considered, the groove 720*b* formed in the side of the rotatable cam 720 is spiral and the rotatable cam 720 moves in the right-left direction by receiving reaction power from the guide rib 730 as guided by the groove 720*b* according to the rotational direction.

Further, the compression spring 740 attached to the right and left sides of the rotatable cam 720 is supposed to work with established forces, and always pushes the rotatable cam 720 toward the middle when the rotatable cam 720 is pushed to one side.

The object of this operation is to move the guide rib 730 into the spiral groove 720*b* readily when the rotatable cam 720 rotates in the opposite direction.

As the rotatable cam 720 maintains, with guide rib 730, the state shown in FIG. 5 when picked up and rotating, the surface of the rotatable cam 720 and the guide rib 730 maintain the state of separation, and the pickup roller 23, the paper P and the knockup plate 22 maintain a state of contact.

In this state, when the line feed motor 24 begins to rotate in the direction of the line feed, the paper is transported to the printing position and, at the same time, the guide rib 730 begins to enter the spiral groove 720*b* of the rotatable cam 720, and the rotatable cam 720 starts to move from the right side to the left side.

Furthermore, the guide rib 730 approaches the cam surface 720*c*. When rib 730 finally reaches the surface 720*c*, the paper sheets of the knockup plate 22 are separated from the pickup roller 23, and the fed paper sheets do not impose a load on the pickup roller 23.

The opposite direction of operation of the pickup roller 23 does not occur at the initial operation, and also at subsequent operation, as a result of operation of the speed reducing gear 26 as mentioned above.

As explained in the above, the sheets of paper P are picked up from the automatic paper feeder part 20 and fed by the feed roller 31 and the friction roller 32. The unnecessary load applied to the pickup roller 23 at the rear edge of the paper in movement, and to the knockup plate 22, is reduced. The excessive pressure increase, and the load of the friction roller 32 to prevent the paper from slipping, are also eliminated. A uniform quality for line feed can be gained by feeding the paper P without excessive load at the beginning. Accordingly, the printing problems such as white line, etc. are prevented.

It should be understood that the present invention is not limited to the particular embodiment disclosed herein as the best mode contemplated for carrying out the present invention, but rather that the present invention is not limited to the specific embodiments described in this specification except as defined in the appended claims.

What is claimed is:

1. A device for a pickup roller of a printer having a knockup plate and a paper feeder, said device comprising a rotatable cam device mounted on an edge of the knockup plate for separating paper located on the knockup plate from the pickup roller when paper feeding is completed.

2. The device of claim 1, wherein said rotatable cam device comprises:

a guide rib mounted on the upper edge of the knockup plate for separating the pickup roller and the paper;

a rotatable cam located in a center of said device for selectively mounting and dismounting the guide rib in response to power from a driving unit; and a compression spring disposed on both sides of said rotatable cam for continuously pushing said rotatable cam toward a center of a left-right movable path of said rotatable cam.

3. The device of claim 2, wherein said rotatable cam has a spiral groove formed on one side thereof adjacent to said guide rib.

4. The device of claim 3, wherein said rotatable cam has a surface adjacent to said spiral groove, and said guide rib moves into said spiral groove and toward said surface as said paper is fed by said pickup roller.

5. The device of claim 4, wherein said guide rib separates said paper and said pickup roller when said guide rib contacts said surface at an end of movement of said guide rib in said spiral groove.

6. The device of claim 1, wherein said printer comprises an inkjet printer.

7. In a printer including a paper feeder having a knockup plate for holding paper to be fed and a pickup roller for withdrawing the paper from the knockup plate;

a rotatable cam device mounted on an edge of the knockup plate for separating paper located in the knockup plate from the pickup roller when a paper feeding process is completed.

8. In the printer of claim 7, wherein said rotatable cam device comprises:

a guide rib mounted on the upper edge of the knockup plate for separating the pickup roller and the paper;

a rotatable cam located in a center of said device for selectively mounting and dismounting the guide rib in response to power from a driving unit; and a compression spring disposed on both sides of said rotatable cam for continuously pushing said rotatable cam toward a center of a left-right movable path of said rotatable cam.

9. In the printer of claim 8, wherein said rotatable cam has a spiral groove formed on one side thereof adjacent to said guide rib.

10. In the printer of claim 9, wherein said rotatable cam has a surface adjacent to said spiral groove, and said guide rib moves into said spiral groove and toward said surface as said paper is fed by said pickup roller.

11. In the printer of claim 10, wherein said guide rib separates said paper and said pickup roller when said guide rib contacts said surface at an end of movement of said guide rib in said spiral groove.

12. In the printer of claim 7, wherein said printer comprises an inkjet printer.

13. A device for a pickup roller in a printer having a knockup plate for holding paper to be fed, wherein said pickup roller has a feeding mode in which said pickup roller withdraws paper from said knockup plate and a non-feeding mode;

said device comprising a rotatable cam device mounted on said knockup plate for maintaining contact between said pickup roller and the paper in said knockup plate during the feeding mode, and for separating said pickup roller from the paper in said knockup plate during the non-feeding mode.

14. The device of claim 13, wherein said rotatable cam device comprises:

a rotatable cam mounted on a shaft and driven by a driving unit of said printer; and a guide rib located adjacent to said rotatable cam for engaging said rotatable cam as it is driven by said driving unit.

15. The device of claim 14, wherein said rotatable cam has a spiral groove formed on one side thereof adjacent to said guide rib.

16. The device of claim 15, wherein said rotatable cam has a surface adjacent to said spiral groove, and said guide rib moves into said spiral groove and toward said surface as said paper is fed by said pickup roller.

17. The device of claim 16, wherein said guide rib separates said paper and said pickup roller when said guide rib contacts said surface at an end of movement of said guide rib in said spiral groove.

18. The device of claim 13, wherein said rotatable cam device comprises:

a rotatable cam mounted on a shaft and driven by a driving unit of said printer; and compression spring means mounted on said shaft on opposite sides of said rotatable cam for constantly urging said rotatable cam toward a center point on said shaft.

19. The device of claim 18, wherein said cam device further comprises a guide rib located adjacent to said rotatable cam for engaging said rotatable cam as it is driven by said driving unit.

* * * * *